United States Patent [19]

Heffley et al.

[11] Patent Number: 5,048,167

[45] Date of Patent: Sep. 17, 1991

[54] METHOD FOR RESTORING USED MATTRESSES

[76] Inventors: James R. Heffley; James R. Heffley, Jr., both of 11495 W. 77th Dr., Arvada, Colo. 80005

[21] Appl. No.: 321,917

[22] Filed: Mar. 13, 1989

[51] Int. Cl.[5] ..... B68G 7/00

[52] U.S. Cl. ..... 29/91.1; 29/402.03; 29/402.08; 29/420.11; 29/426.1; 5/447; 5/462; 5/464; 5/475

[58] Field of Search ..... 29/402.01, 402.03, 402.04, 29/402.05, 402.06, 402.08, 402.11, 402.16, 911, 426.1; 53/472, 524; 5/446, 447, 475, 480, 464, 462

[56] References Cited

U.S. PATENT DOCUMENTS

| | | | |
|---|---|---|---|
| 1,334,745 | 3/1920 | Farr . | |
| 1,484,869 | 2/1924 | Brandwein . | |
| 1,592,308 | 7/1926 | McCullough . | |
| 1,669,721 | 5/1928 | McCullough . | |
| 1,672,305 | 6/1928 | Coda . | |
| 1,682,394 | 8/1928 | Meutsch | 5/464 X |
| 1,722,734 | 7/1929 | Coghlan et al. . | |
| 3,118,153 | 1/1964 | Hood | 5/464 X |
| 3,310,613 | 3/1967 | Lundberg | 264/36 |
| 3,594,833 | 7/1971 | Richter | 5/480 X |
| 3,833,259 | 9/1974 | Pershing | 5/464 X |
| 3,846,857 | 11/1974 | Weinstock | 5/464 |
| 4,517,723 | 5/1985 | Tschan | 29/235 |
| 4,570,323 | 2/1986 | Legerius et al. | 29/451 |
| 4,761,872 | 8/1988 | Buettner et al. | 29/451 |
| 4,907,309 | 3/1990 | Breckle | 5/480 X |

FOREIGN PATENT DOCUMENTS

| | | | |
|---|---|---|---|
| 8102384 | 9/1981 | PCT Int'l Appl. | 5/447 |
| 352386 | 8/1931 | United Kingdom . | |

*Primary Examiner*—Mark Rosenbaum
*Assistant Examiner*—Frances Chin
*Attorney, Agent, or Firm*—John E. Reilly

[57] ABSTRACT

A process has been devised for restoring full-sized innerspring mattresses by removing the end of the mattress cover to expose the coils, inserting resilient blocks of material into the spaces between adjacent rows of coils whereby to extend the full length of the mattress, and reclosing the mattress cover. A special form of resilient block is employed which is of graduated firmness, and an insertion tool greatly facilitates insertion of the blocks for the full length of ther mattress, following which the tool can be removed.

12 Claims, 1 Drawing Sheet

METHOD FOR RESTORING USED MATTRESSES

This invention relates to methods and means for restoration of used mattresses, cushions and the like; and more particularly relates to a novel and improved method and apparatus for restoring large mattresses of the type having innersprings arranged in rows and contained within a mattress cover.

BACKGROUND AND FIELD OF THE INVENTION

It is not uncommon to employ resilient blocks of material, such as, plastic foam within innerspring mattresses as a part of the original assembly process. Typically, the resilient blocks traverse a limited portion of the mattress, such as, the intermediate portion and requires manual pulling of the foam or block between innersprings. Characteristically, such mattresses are advertised as being reinforced but in such cases typically the reinforcing blocks do not fully occupy the space between innersprings and, for example, do not traverse the entire length or breadth of the mattress. Furthermore, when used as a part of the original manufacture of the mattress, the principal support elements are the spring members.

In the stuffing or restoring of cushions, it has been proposed to use various types of insert tools but primarily have been concerned with the insertion of relatively loose fill or stuffing material. Representative patents illustrating various approaches that have been taken in the past are British Patent No. 352,386 to L. Iske and U.S. Pat. Nos. 1,334,745 to E. C. Farr; 1,722,734 to T. Coghlan et al and 3,310,613 to H. J. Lundberg. In the latter, a foaming composition is inserted into a fabric envelope which is inserted into position and then allowed to "foam in place".

Other patents of interest in this field are U.S. Pat. Nos. 1,484,869 to H. G. Brandwein; 1,592,308 to G. C. McCullough; 1,672,305 to C. F. Coda; 1,669,721 to G. C. McCullough; 4,517,723 to R. Tschan; 4,570,323 to B. E. Legerius et al; and 4,761,872 to C. J. Buettner et al.

This invention is concerned with large innerspring mattresses of the type in which the innerspring coils are not encased in any fabric and are constructed so that the individual coils are aligned so as to leave a substantially uniform space between adjacent rows of coils. In the past, even though the outer cover of a used mattress exhibits little or no wear, the mattress must be discarded because of damage to individual coils or loss of desired firmness in particular sections of the mattress. Innerspring mattress constructions of this type presents different problems than those confronting one concerned with restoring furniture or smaller cushions. Thus, in order to restore a used mattress to its original condition, the desired degree of firmness must be reestablished in a vertical direction, it should provide a level sleeping surface with no hard or soft spots and should be returned to its original shape or designed firmness and be maintenance free. Another consideration is that typically the less expensive mattresses have a smaller number of coils per unit area and therefore a larger space between rows of coils which must be filled to support the coils for the desired resiliency as well as forcing the coils back to their original position so that the coils work properly in a vertical or up-and-down direction as opposed to falling sideways as the coils have a tendency to do when they become old and lose their elasticity, or the connecting wires become severed.

As demonstrated by the patents previously referred to, it has been proposed to provide different filling materials for cushions. Typically, the filling has little or no elasticity and does not provide a level sleeping surface. If the materials used to fill the voids between the coils are too soft, they fail to offer the support necessary for the coils to return the mattress to a firm and level sleeping surface. Moreover, for larger mattress areas to be restored, loose fill or foam-in-place materials are difficult to insert and to uniformly fill a space or void. On the other hand, use of self-contained materials have, as earlier noted, been used in the construction of the mattress as a piece of original equipment where the materials are manually inserted into limited sections of the mattress; to the best of our knowledge, however, no one has satisfactorily devised a method or tool by which resilient blocks of material can be inserted between rows of innersprings in a used mattress throughout the entire length or breadth of the mattress and in such a way as to restore the desired firmness or resiliency to the mattress in a relatively simple and low-cost, highly efficient manner.

SUMMARY OF THE INVENTION

Accordingly, it is an object of the present invention to provide for a novel and improved method and device for restoring used mattresses and specifically mattresses of the type having innerspring members therein.

It is another object of the present invention to provide for a novel and improved method for restoring mattresses which involves and requires a minimum number of steps and tools; and further wherein the method of the present invention is conformable for use in restoring innerspring mattresses of any size.

It is further object of the present invention to provide for a novel and improved elastic block construction for restoring mattresses wherein the blocks can be rapidly inserted into position, and further to provide for a novel form of inserter tool usable in cooperation with an elastic block of material and which will facilitate insertion of the blocks along the full length of the mattress.

It is an additional object of the present invention to provide for a method and device capable of restoring used mattresses to the desired firmness; and further wherein extended lengths of resilient blocks of material can be effectively compressed for extension between rows of innerspring elements of the mattress.

In accordance with the present invention, a process has been devised for restoring used mattresses of the type having rows of innerspring coils enclosed within an envelope or cover and wherein the process comprises the steps of removing one end of a cover to expose the coils, providing a resilient block of material sized to fill each space between adjacent rows of coils, each block of material having a limited resiliency and a length and cross-sectional size corresponding to the length and cross-sectional size of the space between coils, inserting each block of material lengthwise into the space between adjacent rows of coils from the one exposed end of the mattress, and reclosing the mattress cover along the one end of the mattress. In carrying out the process of the present invention, a resilient block of material has been devised consisting of longitudinal layers of different firmness and specifically wherein an intermediate layer is of greater firmness than the upper and lower or outer layers. In addition, an insertion tool is provided for compressing the block as it is inserted into the space between rows of springs and following which the tool may be withdrawn from engagement with the block.

The above and other objects, advantages and features of the present invention will become more readily appreciated and understood from a consideration of the following detailed description of a preferred embodiment of the present invention when taken together with the accompanying drawings of a preferred embodiment of the present invention, in which:

DETAILED DESCRIPTION OF THE PREFERRED EMBODIMENT

Figure 1:
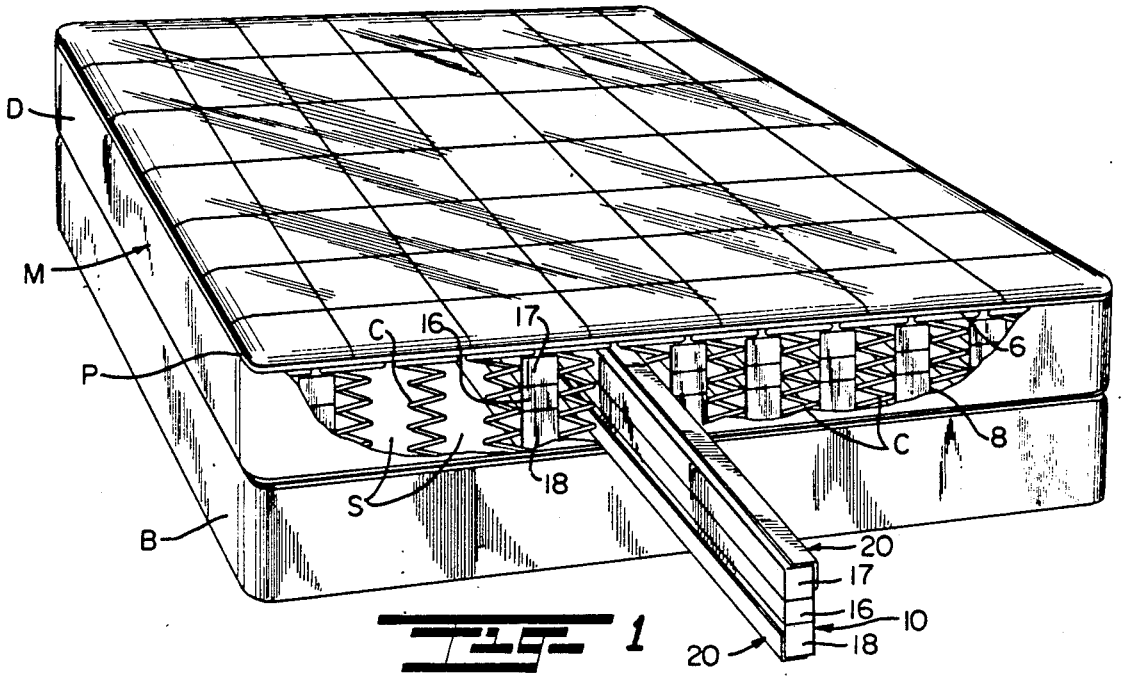
FIG. 1 is a perspective view illustrating the preferred manner of carrying out the process of the present invention in the restoration of an innerspring mattress.
Figure 2:
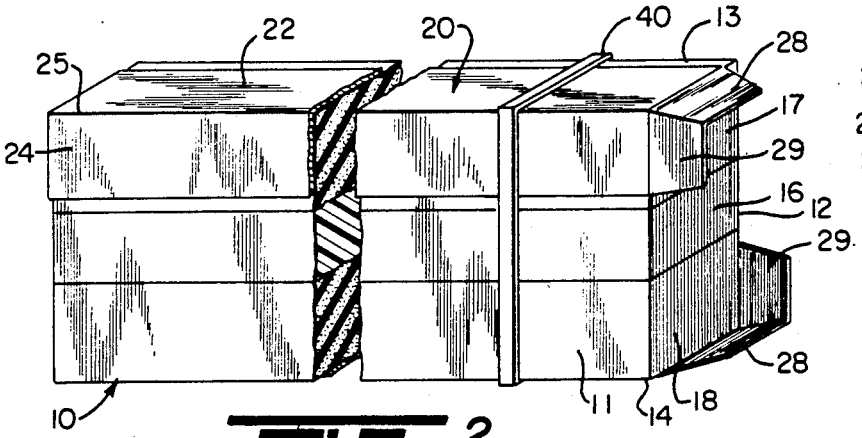
FIG. 2 is a perspective view in more detail illustrating the preferred form of elastic block and insertion tool employed in the restoration of mattresses.
Figure 3:
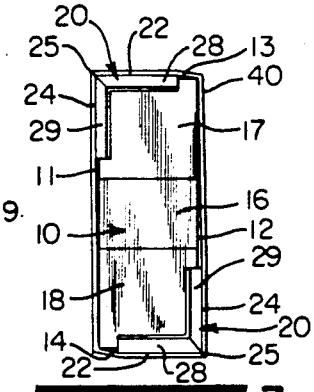
FIG. 3 is an end view of the elastic block and inserter illustrated in FIG. 2.
Figure 4:
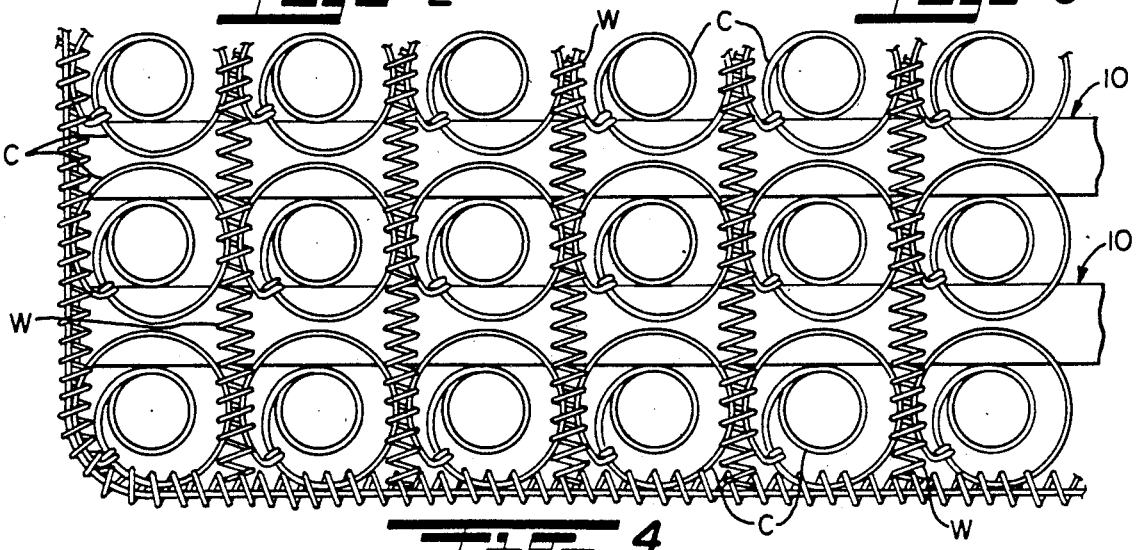
FIG. 4 is a fragmentary view of a mattress and illustrating the disposition of a series of blocks in fully inserted position in a mattress.

Referring in more detail to the drawings, there is illustrated in FIGS. 1 to 4 a preferred method and device for restoring used mattresses and the like. As a setting for the present invention, both the method and device may be best typified by describing their construction and use with a king or queen size mattress which may be on the order of 80" in length, and the innerspring mattress M is shown supported by box springs B. As illustrated in FIGS. 1 and 4, typically the innerspring mattress has rows of innerspring coils represented at C, each row extending the full length of the mattress and leaving spaces or gaps between adjacent rows, such as, represented at S. It should be emphasized in this regard that the spaces or gaps S between adjacent rows must be substantially straight or of substantially uniform width for purposes of the present invention and extend either uniformly in a lengthwise or transverse or crosswise direction with respect to the mattress. In a conventional mattress, the individual spring coils may converge inwardly from larger upper and lower ends 6 to an intermediate portion 8, leaving a space or gap S between adjacent rows of coils, as best seen from FIG. 1. The coil alignment of an innerspring mattress is retained at the top and bottom from one side to the other with helical wires W that hold the coils in place so that the coils will absorb the weight of a person lying on the mattress and provide a firm but elastic support for the padding P that is placed between the mattress springs and upper and lower mattress cover portions. In the standard mattress, the spacing between rows of coils may typically vary between 1½" to 2" wide and be of a height of 4½" to 5" between the top and bottom paddings, helical wires and springs.

Generally, after extended use, mattresses lose the desired degree of firmness, at least in certain sections of the mattress, and no longer provide a level sleeping surface. Thus, while the outer surrounding cover D of the mattress may remain in perfect condition and capable of extended use, the mattress must be discarded for lack of a comfortable, level sleeping surface. An important feature of the present invention is to restore the sleeping surface of an innerspring mattress that has lost the desired firmness or resiliency either as a result of bent springs, helical wires or reduction in elasticity in the individual springs. To this end, it is desirable to fill each of the spacings S with a block of material and in such a way as to support the coils in an up-and-down, or vertical, position as well as to provide the necessary vertical support to restore the desired uniform firmness and level sleeping surface to the mattress. Accordingly, the insert members are preferably comprised of unitary blocks of material as represented at 10, each block being of a length corresponding to the length of the spacing S and having a cross-sectional size which will occupy the width between adjacent coils and the height or depth between the upper and lower pads. As shown, each block 10 is of generally rectangular cross-section having opposite sides 11, 12 and top and bottom surfaces 13 and 14. Furthermore, each block is made up of a relatively firm intermediate layer or center core 16 of generally rectangular cross-sectional configuration and relatively soft upper and lower layers 17 and 18, respectively. For example, the intermediate layer 16 may be composed of a polyethylene foam having a compressive strength, using test ASTM D 3575 Suffix D of 3.75 psi at 10%, 6.5 psi at 25% and 15.0 psi at 50%; and the density is 1.7 pounds per cubic foot. For a space S having a total height of 5" and a width of 2", the layer 16 may be on the order of 1" high and 2" in width by 80" in length. The upper and lower layers 17 and 18 are preferably composed of a polyurethane foam having an indentation load deflection rating ("ILD") on the order of 33 pounds to 50 pounds with a density of 1.3 pounds to 1.5 pounds per cubic foot and being dimensioned 2" by 2" by 80".

The upper and lower layers 17 and 18 are joined to top and bottom surfaces of the intermediate layer 16 by a suitable solvent-based adhesive, such as, that sold under Model No. 17948 by Reichhold Chemicals, Inc. of Chicago, Ill. The center layer 16 may be a 1.7 pound per cubic foot polyethylene sold under the trademark "POLYLAM ®" by Central Foam Products of Dallas, Tex. The inner core or layer 16 is important from the standpoint of lending structural integrity to the elongated block or strip of material but at the same time provides some elasticity so as not to be susceptible of breaking under heavy or sudden loads while providing the necessary stability to the entire block for inserting and holding the coils apart during use. The hard inner core or layer 16 may be composed of other materials possessing some elasticity but if made even firmer, most desirably the outer layer 17 and 18 should be decreased in hardness to compensate for that of the center core 16.

In order to facilitate placement of the blocks 10 in position within the spaces between the coils of a full-sized mattress, an angle insertion tool 20 is made up of a pair of angle shaped inserters, each inserter having flat plates 22 and 24 interconnected at right angles to one another and of a length substantially corresponding to the length of each block to be inserted. The plates 22 and 24 are connected at a common line of intersection 25 so as to be complementary to one of the upper longitudinally extending corners of the upper layer 17. Correspondingly, the lower inserter of the tool 20 has interconnected plates 22 and 24 with a common line of intersection 25 to be complementary to one of the lowermost longitudinally extending corners or edges of the lower layer 18. As seen from FIG. 3, preferably the lower inserter is applied to a corner which is diagonally opposite to that of the upper inserter. Each inserter is correspondingly provided with leading tapered ends 28 and 29 which form forward tapered extensions of the plates 22 and 24, respectively. In other words, the front of each inserter has a side plate folded slightly inwardly toward the center and a top plate folded slightly downwardly so that the ends of the inserters are capable of passing under any bent helical wires W, or inside any bent innerspring C, in forcing the helical wires W and the innerspring C to return to their original position.

Preferably, the angle inserters are composed of an anodized aluminum and which for a block having an overall height of 5" and a width of 2" would be dimensioned to be 1½"×1½" by 85" in length. Preferably, the aluminum plates 22 and 24 are treated with a "TEFLON®" or other low coefficient of friction material but which has sufficient friction against the block to hold it securely as the foam is inserted into the space but nevertheless can be removed independently of the foam block 10 after the block has been fully inserted between the rows of coils. The leading tapered ends 28 and 29 may be on the order of 2" and are bent inwardly at a degree such that the front edges can easily pass under the helical wires W and any interior bent coils and urge those elements back into their original position as the foam block is inserted into the space.

In operation and use, the angle inserters are placed at opposite diagonal corners of a foam block 10, and a rubber band 40 is placed around the front end of the inserters 20 and the block 10 approximately 4" back from the front edge of the block in order to hold the front of the assembled inserters and block stable as they are inserted into the innerspring space and to exert a slight compression on the front end. At the foot end of the mattress the seams or stitches that hold the fabric tape to the top sheet of the mattress and the border of the mattress are removed so as to permit the border to be lowered out of the way and expose the innersprings and the spaces S between the coils. The foam block and tool 20 are placed into one of the void spaces S by squeezing the top and bottom inserters together while pushing it into the void space so that the leading end reaches the opposite end of the mattress. This process is repeated until each space between adjacent rows of coils has been filled with a foam block, as illustrated in FIG. 1. The end of the mattress is then reclosed to complete the restoration process.

As will be appreciated from the foregoing, the preferred form of blocks 10 is described as having a graduated hardness and preferably with the firmness greatest in the region of the center core 16 to permit insertion over unusually extended distances, particularly for the height and width of the block. Thus, the blocks are extremely narrow in relation to their length but yet have demonstrated sufficient stability that they can be effectively advanced over the necessary distances to enable full or substantially full insertion of the blocks. The angle type inserters cover a sufficient area of the block to avoid any tendency of the foam material to become snagged or blocked by any bent wires or coils but at the same time do not cover so much of the block as to develop undue frictional resistance to independent removal of the inserters 20 once each block 10 has been fully inserted. A foam block without the hard core 16 can be inserted in the same manner as described with reference to the preferred form of block 10; however, the foam tends to be unstable and bunches up so as to be very difficult to insert. Accordingly, the process without the graduated firmness or hard center is much more time-consuming and uncertain in filling an innerspring mattress and therefore not as practical or fast enough for commercial use.

It will be evident that the size of the space between coils and height of the space may vary depending upon manufacture and quality of the mattress. Again, the less expensive mattresses have a smaller number of coils per mattress unit and therefore a larger space between each row of coils, creating a larger space that must be filled to support the elasticity of the coils for an up-and-down motion as well as enforcing the coils back to their original position. Thus, by straightening the coils they are forced to work up and down rather than sideways as coils have a tendency to do under repeated wear and use. Thus, a less expensive innerspring mattress may require a foam block on the order of 2" in width while more expensive mattresses require a block on the order of 1" to 1½" in width. The foam block again should be on the order of 4½" to 5" in total height in order to contact the insides of the top and bottom paddings, the helical wires W and the spring coils C. If the foam block is not wide enough to contact the coils on either side, the block will tend to bend in the middle to one side or the other and lessen the amount of support that the foam can provide when it is depressed and forced down into its own mass. If a foam block is used that is not of a proper height, then the support may be lessened since the foam will not offer the necessary support until the mattress has been depressed enough for the padding, top and bottom of the coils C and helical wires W to contact the foam block 10. A mattress innerspring unit that has been used enough to be soft will have areas that are softer than others and especially in the middle one-third where most of the body weight is concentrated when a person sleeps on the mattress. It is important to support that weight with the foam block 10 as soon as the weight of a person touches the padding of the mattress. With a foam block that is not high enough, a lighter person might not depress the mattress far enough to contact the foam block and thus not attain a firm, level sleeping surface which is uniform throughout the mattress. It has been found that the use of 33 pound to 44 pound ILD rated polyurethane foam for the top and bottom layers 17 and 18 offers optimum support but still not too hard to be felt through the mattress surface as a hard strip. The inner core of 1.7 pounds polyethylene foam with a compressive strength as described affords some elasticity but since it is not like a solid piece of wood cannot be broken by the use of the mattress and yet afford the necessary stability for inserting and holding the coils apart during use. The hard center core 16 may be composed of any materials possessing some elasticity bearing in mind that the core contributes to the overall firmness of the block 10. If a firmer core is used, the outer layers 17 and 18 should be decreased in hardness to avoid making the overall block too hard and result in the blocks being felt on the surface of the mattress as a hard strip running from the head to toe of the mattress. A hard core 16 on the order of ¾" to 1½" in thickness has been found to lend the necessary stability for insertion of the block and with the outer layers 17 and 18 being of equal thickness to completely fill the space. Once the blocks have been placed between the rows of coils and are of the proper height and width, they have been found to be extremely effective in lending the necessary support where the mattress was weakened and therefore will return the entire mattress surface to a constant or uniform feel of firmness throughout. Moreover, where one innerspring coil is damaged more than the other, the foam blocks offer a sufficient support to return the mattress to its original feel of firmness since the blocks will then serve as the primary means of support.

It is therefore to be understood that various modifications and changes may be made in the preferred form of method and device as described in restoring mattresses to their original condition without departing from the spirit and scope of the present invention as defined by the appended claims and reasonable equivalents thereof.

We claim:

1. A method for restoring used mattresses of the type having spaces between rows of spring coils enclosed in a mattress cover comprising the steps of:

removing one end of said cover to expose said coils;

providing a block of material for filling each space between adjacent rows of coils, said block of material having limited resiliency and substantially corresponding to the length and cross-sectional size of each said space;

inserting each said block of material lengthwise into each said space from the one exposed end of said mattress; and reclosing said mattress cover along the one end of said mattress.

2. The process according to claim 1, including the step of compressing at least a leading end of each said block transversely of its direction of extension through each said space.

3. The process according to claim 2, including the step of compressing opposite diagonal corners of said block as it is advanced through each said space from the one end thereof.

4. The process according to claim 1, including the step of forming said block of layers of material of different hardness, adhesively securing said layers together into a unitary block in which an intermediate section of said block is harder than outer layers thereof.

5. The process according to claim 4 in which upper and lower layers of said block are of less firmness than said intermediate section.

6. The process according to claim 1, each said block composed of a foam plastic material having a resiliency substantially corresponding to that of said spring coils.

7. A process for restoring mattresses of the type having spaced rows of coils enclosed in a mattress cover comprising the steps of:

removing one end of said cover to expose said coils;

providing a block of material for filling each space between adjacent rows of coils, said block of material having limited resiliency and is sized to correspond to the length and height of each said space;

compressing at least a leading end of each said block transversely of its direction of extension through each said space and inserting said block in a lengthwise direction into each said space from the one exposed end of said mattress until it reaches the opposite end of said mattress; and reclosing said mattress cover along the one end of said mattress.

8. The process according to claim 7, including the step of compressing opposite diagonal corners of said block as it is advanced through each said space from the one end thereof.

9. The process according to claim 7, including the step of forming each said block of a material having a graduated hardness in which the intermediate section is less resilient than upper and lower sections thereof.

10. The process according to claim 7 in which a section of said block is composed of longitudinally extending layers of plastic foam adhesively secured to one another.

11. The process according to claim 10, each said block composed of layers of a foam plastic material having a resiliency substantially corresponding to that of said coils.

12. The process according to claim 7, said block having upper and lower longitudinally extending layers having a density in the range of 1.3 pounds to 1.5 pounds per cubic foot and an intermediate longitudinally extending layer having a density in the range of 1.7 pounds per cubic foot.

* * * * *